United States Patent [19]

Laird et al.

[11] 4,114,911

[45] Sep. 19, 1978

[54] SKI POLE

[76] Inventors: Richard Alan Laird, The Lantern House, Chiselhurst, Kent; Geoffrey Desmond Burnham, 50 Hill View Rd., Orpington, Kent, both of England

[21] Appl. No.: 778,386

[22] Filed: Mar. 17, 1977

[30] Foreign Application Priority Data

Mar. 1, 1977 [GB] United Kingdom ..... 8582/77

[51] Int. Cl.[2] ..... A63C 11/22

[52] U.S. Cl. ..... 280/11.37 F; 248/155.1

[58] Field of Search ..... 280/11.37 R, 11.37 F, 280/11.37 E, 11.37 J; 248/155, 155.1; 135/66

[56] References Cited

U.S. PATENT DOCUMENTS

| | | | |
|---|---|---|---|
| 2,690,211 | 9/1954 | Wentz | 248/155.1 |
| 3,712,652 | 1/1973 | Vilkema | 280/11.37 F X |
| 3,722,903 | 3/1973 | Jones | 280/11.37 F |

FOREIGN PATENT DOCUMENTS

| | | | |
|---|---|---|---|
| 472,040 | 9/1937 | United Kingdom | 280/11.37 F |

*Primary Examiner*—Joseph F. Peters, Jr.
*Assistant Examiner*—Gene A. Church
*Attorney, Agent, or Firm*—Newton, Hopkins & Ormsby

[57] ABSTRACT

A ski pole has two or more sections which telescope into another to reduce the length thereof to enable the pole to be used as a seat. The handle of the pole unfolds in two halves to provide a horizontal seat support for a user.

1 Claim, 7 Drawing Figures

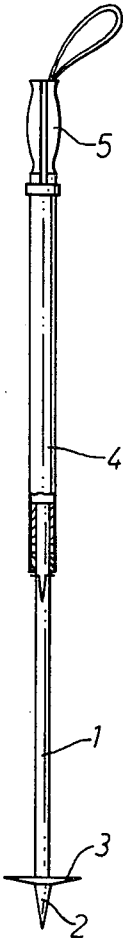
FIG. 1.
FIG. 2.
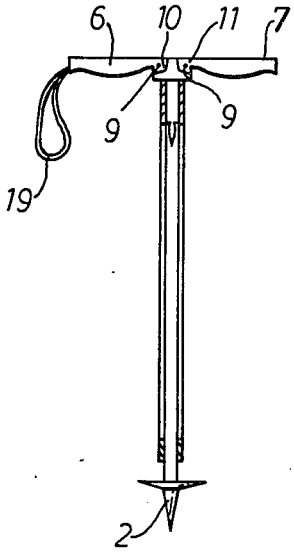
FIG. 3.
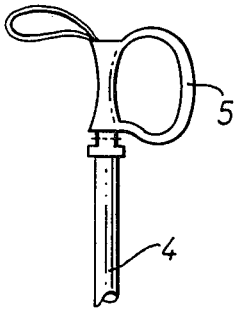
FIG. 4.
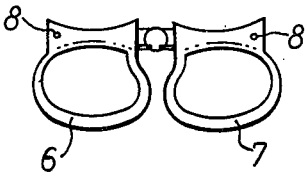
FIG. 5.

SKI POLE

FIELD OF THE INVENTION

This invention is concerned with the provision of a ski-pole which is convertible into a foldable seat.

BRIEF DISCUSSION OF THE PRIOR ART

Conventional equipment for skiing includes two poles each of which essentially consists of a tubular metal member provided with a "basket", often of plastics material, about 4 inches from the bottom. At the top end is a handle or grip, including a wrist strap, all of which consists of leather or, more recently, plastic. After a skier has donned his skis, it is practically impossible for him to sit down without removing his skis, and even if he did that, there is rarely anything on the mountain on which he could sit, apart from the cold snow. Skiing is tiring and frequently skiers spend a long time queuing for the ski lifts.

In modern times ski resorts tend to be overcrowded, seats are rarely available in mountain restaurants etc. and we believe that this invention will be appreciated by people unable to find other seating accommodation.

SUMMARY OF THE PRESENT INVENTION

An object of the invention is to provide a ski pole which is easily convertible into a folding seat without detracting from the principal use as a ski pole. It is worth mentioning here that by protecting the bottom spike with a simple heel, the same stick can be used for sitting indoors, on railway platforms and so on.

According to the present invention we provide a ski pole comprising two sections adapted to telescope into one another to reduce the length of the ski pole for use as a seat and adapted to be opened out and secured in extended position for use as a ski pole, the upper end of the ski pole being provided with means which provide a seat support when it is desired to use the stick as a seat.

Preferably the means which provide a seat support comprises a handle formed in two parts hingedly mounted on the ski pole to allow the parts to be unfolded.

According to another aspect of the invention a ski pole comprises at least two sections adapted to be manipulated to reduce the length of the ski pole for use as a seat, means for securing the sections together for use as a ski pole, one of said sections including means which can be unfolded to provide a seat support when it is desired to use the ski pole as a seat.

Preferably the ski pole is for all intents and purposes equal to a conventional pole except that instead of a single integral section we preferably provide two sections of slightly different diameters but of approximately equal length, the lower section of which telescopes into the upper section or vice versa. The ski pole handle may then be arranged to split and fold apart to form the seat.

This has been achieved in a preferred embodiment as follows:

a. A larger and a smaller tube.
b. A locking clip.
c. A two piece handle that forms a "D" (the reason for this is to provide a large seating area).
d. The normal wrist retaining strap fixed to one half of the opening "D" and the two parts of the seat folding down to a horizontal position, by means of pins, the mechanism kept closed.

For simplicity, strength and lightness the ski pole may be constructed of aluminium or any other suitable metal and the telescopic mechanism may be slightly simplified. In production the seat may be made from moulded plastics material which is light and comfortable and the telescopic mechanism may be improved by tooling and swaging.

In a preferred embodiment the ski pole becomes a seat by depressing two pins half way up the shaft below the top section which will allow the pole to telescope to approximately half its original length bringing the folding handle to sitting level. For re-use as a ski pole the seat may be folded together again to form the hand grip and the stick extended by a tugging action.

The following points are worthy of note:

a. The ski pole of the present invention when performing its function as a ski pole is every bit as strong as a conventional pole;
b. A simple removable and replaceable clip can be attached to the grip to hold the folding halves together. This could be used to cover the spike, making a heel for use on surfaces other than snow.

BRIEF DESCRIPTION OF THE DRAWINGS

In order that the invention may be more clearly understood reference is now directed to the accompanying drawings given by way of example in which:

FIG. 1 is a sectional side view of a ski pole embodying the invention extended for use as a ski pole;

FIG. 2 is a sectional side view similar to FIG. 1 with the pole closed up for sitting;

FIG. 3 is a detail side view of the handle;

FIG. 4 is a detail plan view of the handle with the seat open;

FIG. 5 is a view of a soft ferrule or plug that may be used in floors and the like;

DESCRIPTION OF THE PREFERRED EMBODIMENTS

Figure 7:
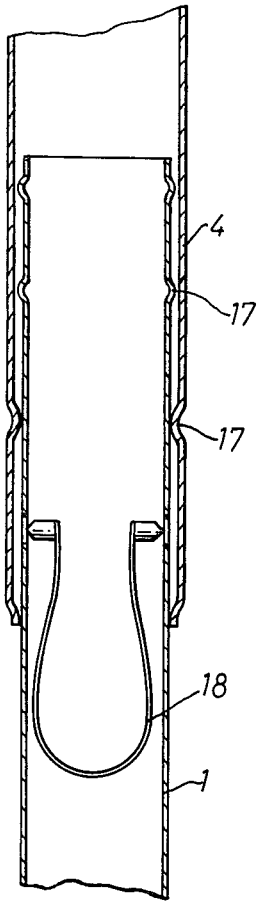
FIG. 7 is an enlarged sectional side elevation of an alternative construction of ski pole.

In the drawings a ski pole consists of a lower section 1 with a spike 2 and a basket 3, an upper section 4 and a handle 5 substantially of D shape in side view when seen in the position shown in FIG. 3. The device may be used as a normal ski pole, with sections 1 and 4 in the position shown in FIG. 1, suitable clip means being provided to hold the two sections in that position. When it is desired to use the pole as a seat the section 1 is telescoped into the hollow section 4 by manually releasing the clip means and the handle 5 is opened out as shown in FIGS. 2 and 4 to provide a seat support in two parts 6 and 7.

Suitable retaining means may be provided to hold the two parts 6 and 7 of the seat in the position shown in FIG. 1 when the device is being used as a ski pole for example a press stud connection 8 is illustrated in FIG. 4. When the device is used as a seat in the position of FIG. 4 the connection 8 is released manually and the parts 6 and 7 opened about their respective pivots 9 (see FIG. 2). In the open position the parts 6 and 7 abut respective shoulders 10 and 11 as shown. As an alternative to the connection 8 the parts 6 and 7 may interengage automatically when brought together.

It will be understood from the above that the handle 5 is formed in two parts or is split down the middle, the two parts being hingedly connected to the upper section 4 of the pole through pivots 9. When in the extended position for use a ski pole the two sections 1 and 4 are locked in the extended position by a spring clip 12 - see FIG. 6. The spring clip 12 is disposed within the upper end of the lower section 1 and has protrusions 13 which pass through holes 14 provided in the lower section 1 when the two sections 1 and 4 are fully extended. As seen clearly from FIG. 6 the two sections 1 and 4 are prevented from complete separation by bushes 15 and 16 secured respectively within the lower end of the upper section 4 and around the upper end of the lower section 1, the bushes 15 and 16 abutting one another on full extension. In order to release the two sections the protrusions 13 are pushed in manually and the sections pushed together.

Figure 6:
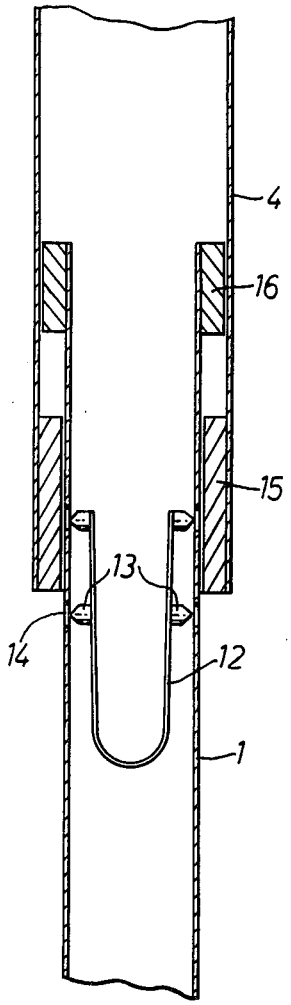
FIG. 6 is an enlarged sectional side elevation of the join between the sections of the pole.

FIG. 7 illustrates in section an alternative construction of the upper and lower sections 4 and 1. In FIG. 7 the sections 1 and 4 are swaged at 17 to provide the necessary abutments to replace the bushes 15 and 16. A single spring clip 18 is shown though a double clip may be used if desired. The advantage of the arrangement of FIG. 7 over the construction of FIG. 6 is that the variation in the diameter of the pole sections 1 and 4 is considerably less in FIG. 7 thus enhancing the appearance of the pole when extended. Although two telescoping sections have been illustrated three or more may be used if preferred.

In a further alternative embodiment (not shown) the wrist strap 19 may be connected between the folding halves of the seat so that when the halves 6 and 7 are folded out the strap is stretched between the halves and becomes the seat. In this embodiment the folding portions need not be enlarged as shown in FIG. 4 but may be merely half a conventional grip since the wrist straps forms the seat.

In order that the seat may be used within a restaurant or bar a ferrule 19 may be provided as shown in FIG. 5 to fit over the spike 2 of the ski pole.

Although the invention has been particularly described with reference to telescoping sections which is the preferred form of the invention the sections merely may be separable to reduce the length of pole for sitting.

What is claimed is:

1. A ski-pole comprising an upper tubular section and a lower tubular section adapted to telescope into one another from an extended to a retracted mode, and each of said sections having a free end, a handgrip at the free end of the upper tubular section, a wrist strap associated with the handgrip, a basket mounted on the lower tubular section adjacent the free end thereof, and releasable securing means between the upper and the lower tubular sections so that by manipulation of said releasable securing means the upper and lower tubular sections may be telescoped relative to one another to reduce the length of the ski-pole, the handgrip at the free end of the upper tubular section including two separable parts, releasable connecting means between the said two parts to retain the two parts in a first position in which the two parts abut one another and are substantially aligned with said upper and lower tubular sections, pivot means associated with each of the two separable parts whereby the parts may be separated from one another by pivotal movement about said pivot means, and an abutment shoulder associated with each separable part for limiting the pivotal movement of the respective separable part, the abutment shoulders defining a second position in which the two parts are substantially in alignment with one another and perpendicular to said upper and lower tubular sections, the arrangement being such that the ski-pole may be used for skiing in the extended mode and as a seat in the retracted mode by unfolding the two separable parts from said first position to said second position respectively.

* * * * *